United States Patent [19]

Starkey et al.

[11] 4,137,040

[45] Jan. 30, 1979

[54] FOOTBALL DRIER

[76] Inventors: Walter D. Starkey, 11769 S. 77 E. Ave., Bixby, Okla. 74008; Rolland W. Chaney, 3717 E. 46 St., Tulsa, Okla. 74135

[21] Appl. No.: 830,842

[22] Filed: Sep. 6, 1977

[51] Int. Cl.[2] ..... F27B 9/02; F26B 25/00

[52] U.S. Cl. ..... 432/128; 34/104; 432/138; 432/184

[58] Field of Search ..... 432/128, 138, 184, 186; 34/104, 106

[56] References Cited

U.S. PATENT DOCUMENTS

| | | | |
|---|---|---|---|
| 699,528 | 5/1902 | Hunt et al. | 432/138 |
| 2,480,227 | 8/1949 | Derr | 34/104 X |
| 3,012,334 | 12/1961 | Davis, Jr. | 34/104 |
| 3,152,875 | 10/1964 | Davis, Jr. et al. | 34/104 |
| 3,319,947 | 5/1967 | Truesdell | 432/186 X |
| 3,645,009 | 2/1972 | Ketchum | 34/104 |
| 3,747,226 | 7/1973 | Graffius | 34/104 |
| 4,055,002 | 10/1977 | Roberts et al. | 34/104 |

*Primary Examiner*—John J. Gamby
*Attorney, Agent, or Firm*—Head, Johnson & Chafin

[57] ABSTRACT

A football drying machine having a frame and wheels so that it may be moved about, a vertical axis supported at its lower end of the frame, a carousel affixed about the vertical axis, the carousel having a number of radial compartments each dimensioned to receive a football, a shroud covering the carousel and having an opening in the top so that as the carousel is rotated the opening aligns with the compartments for placing footballs into or taking them out of the carousel, a gas burner supplied by a gas tank carried on the frame, a fan for moving heated air from the gas burner, a plenum chamber connecting the burner and fan to direct heated air into the bottom of the carousel and within the shroud to heat footballs positioned in the carousel, and a handle affixed to the upper end of the shaft for rotation of the carousel.

7 Claims, 5 Drawing Figures

FOOTBALL DRIER

BACKGROUND AND OBJECTS OF THE INVENTION

The game of football is played during a season of the year in which the climate is frequently cold and wet. A cold and/or wet football loses some of its resiliency and does not kick well. A wet football is slippery, easily mishandled and difficult to throw. For these reasons football officials endeavor to keep balls as warm and dry as possible, usually by simply exchanging balls between plays and drying the balls off with a towel as much as possible.

The present invention is directed towards an apparatus for drying and warming footballs and particularly in an arrangement wherein a supply of warm, dry footballs is kept constantly available. An apparatus is provided wherein cold and/or wet footballs are placed into the machine and moved progressively around within the machine in procession where they are warmed and dried. The warmest and driest football is automatically positioned to be removed from the machine.

It is therefore an object of this invention to provide a football drying machine.

More particularly, an object of this invention is to provide a football drying machine which is self-contained including a frame with wheels whereby the machine may be moved about, including a fuel tank, a burner, a blower, and a carousel arrangement for receiving footballs arranged in such a way that warm air from the blower is passed over the footballs to dry and warm them.

Another more particular object of the invention is to provide a football drying machine including an engine-generator for providing electrical power for operation of the blower fan so that the unit is completely self-contained.

These general objects as well as other and more specific objects of the invention will be fulfilled in the following description and claims, taken in conjunction with the attached drawings.

DESCRIPTION OF THE VIEWS

SUMMARY OF THE INVENTION

A football drying apparatus is formed on a frame with wheels so that it may be moved about. A vertical axis is supported on the frame. A carousel is rotatably supported on the vertical axis, the carousel having a plurality of components dimensioned to receive footballs therein. A cylindrical plenum chamber is positioned below the carousel for receiving warm air and passing it upwardly through the carousel to warm and dry the footballs. A cylindrical shroud surrounds the carousel, the shroud having an opening in the top which is aligned with the compartments in the carousel as the carousel is rotated so that footballs can be inserted and removed. A handle is affixed to the axle above the top of the shroud for rotation of the carousel. A fuel tank is supported on the frame providing fuel to a burner positioned in a burner housing. An electrically driven fan is positioned in the burner housing and a conduit connects the burner housing with the plenum chamber below the carousel so that warm air from the burner is moved through the conduit into the plenum chamber and upwardly through the carousel within the shroud to warm and dry the footballs.

DETAILED DESCRIPTION

Figure 3:
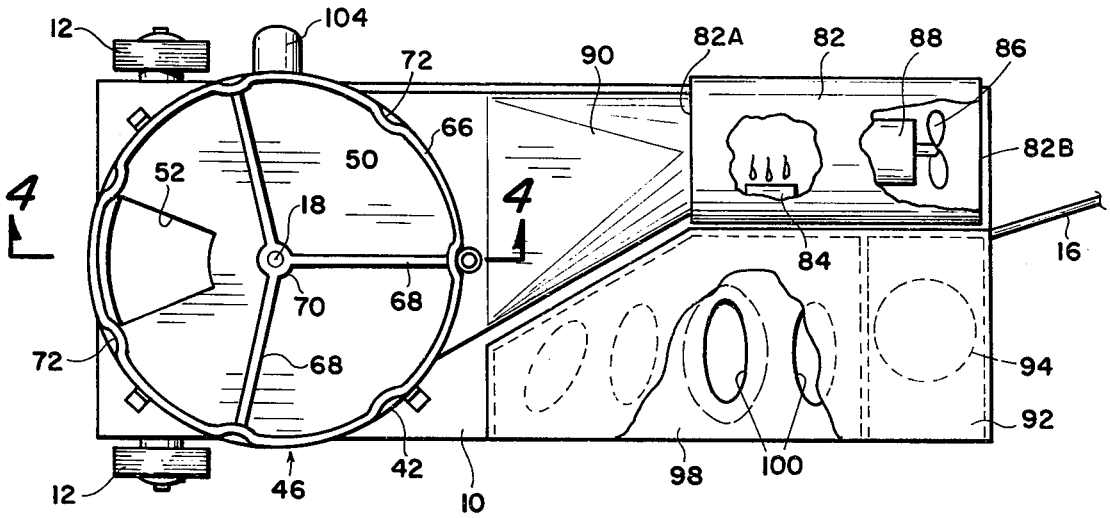
FIG. 3 is a top view of the machine shown partially cut away.
Figure 2:
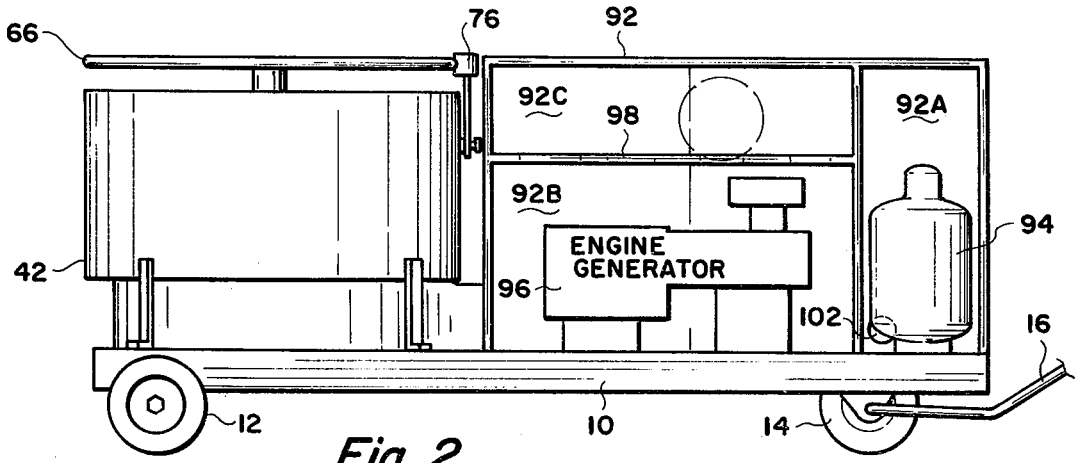
FIG. 2 is a view of the opposite side and with a side panel removed to show components of the machine which are positioned in compartments
Figure 1:
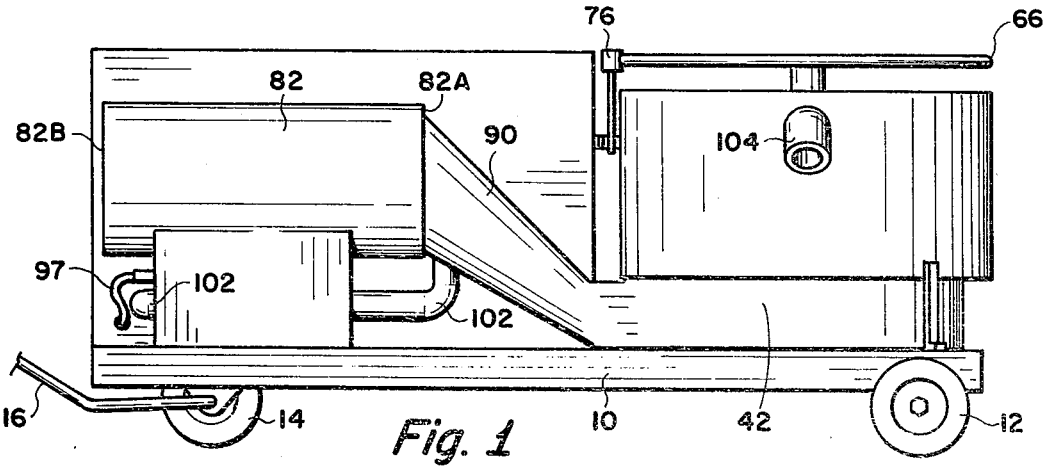
FIG. 1 is a side view of an embodiment of the invention showing a self-contained football drier.
Figure 5:
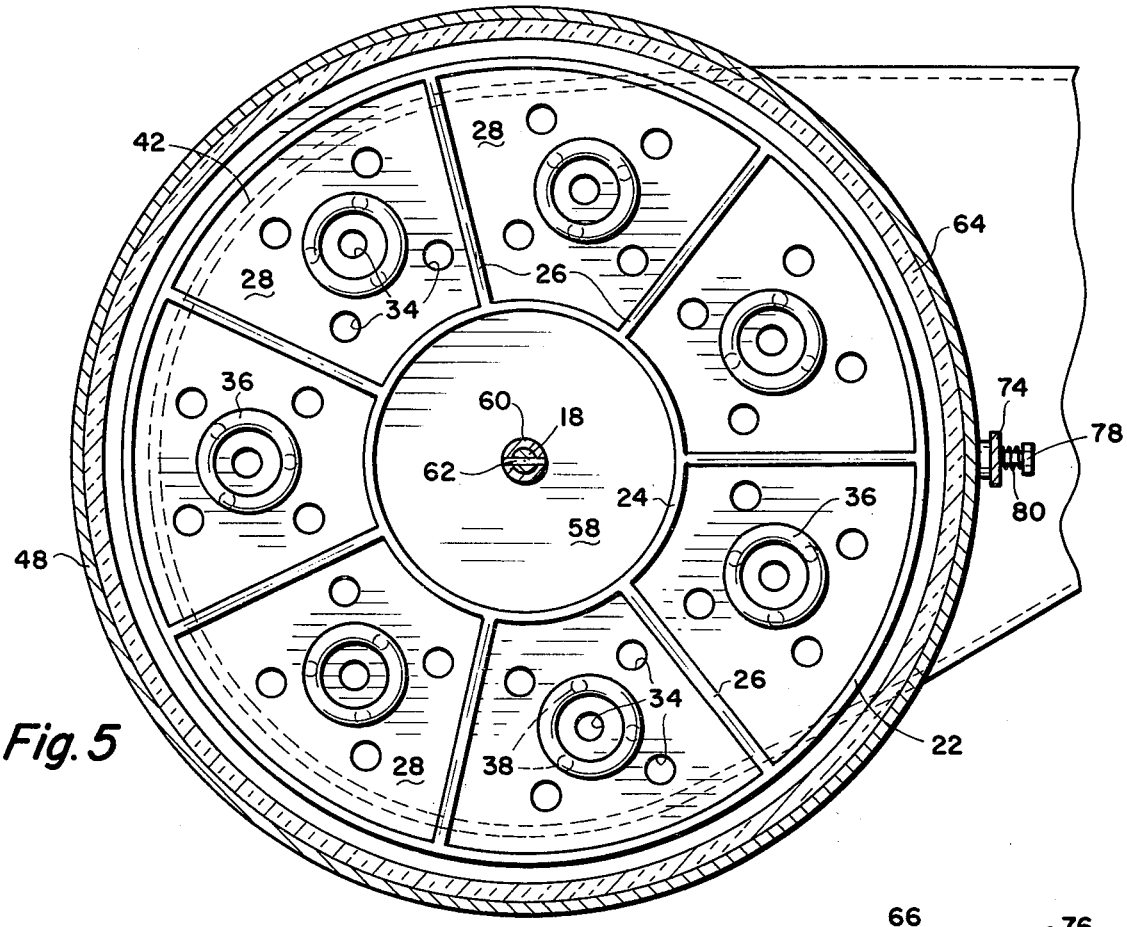
FIG. 5 is a cross-sectional view taken along the line 5—5 of FIG. 4 showing more details of the carousel.

Referring to the drawings and first to FIGS. 1, 2 and 3, the basic structure of the football drying machine is illustrated. The machine is carried on a frame 10 which is generally rectangular. The frame has rear wheels 12 which are spaced to either side of the frame and a front wheel 14 which is pivotally mounted and guided by a tongue 16 so that the football drier may be moved about. It can be seen that the arrangement of the frame 10 and wheels 12 and 14 may vary in many ways.

Figure 4:
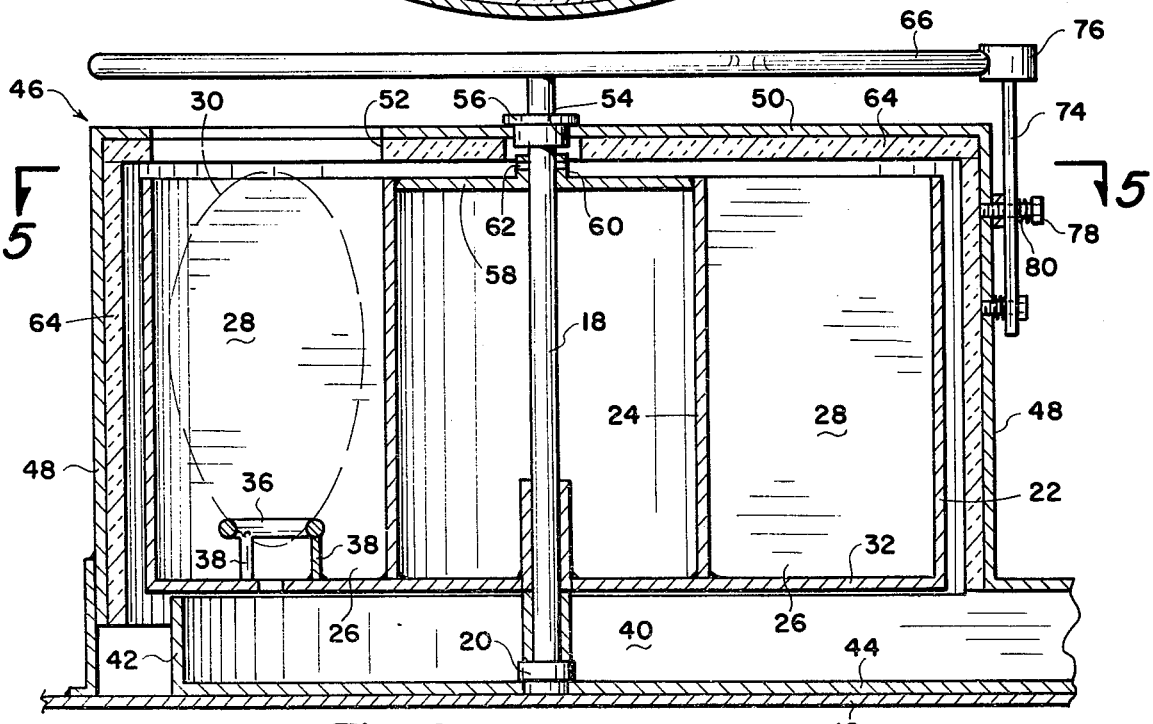
FIG. 4 is a partial cross-section view taken along the line 4—4 of FIG. 3 showing the internal arrangement of the shroud, the carousel within the shroud in which the footballs are positioned and the plenum chamber below the carousel by which air is moved upwardly around the footballs to warm and dry them.

As shown in FIG. 4, positioned on frame 10 is a vertical axle 18 supported to the frame at its lower end by a bearing 20. Affixed to the axle 18 is a cylindrical carousel 22. The carousel has an internal cylindrical wall 24 and a plurality of partitions 26 (seven being illustrated). The partitions divide the interior of carousel 22 into compartments 28. Each compartment 28 is dimensioned so as to freely receive a football indicated in dotted outline in the left compartment of FIG. 4 and identified by the numeral 30. The floor 32 of the carousel has openings 34 therein for the passage of air as will be described in more detail subsequently. The arrangement of holes 34 may vary in many ways and may be replaced by slots or a single wide slot extending around the full circumference of the carousel. Each ring 36 is supported by posts 38 extending from the carousel floor 33.

Positioned beneath carousel 22 is a plenum chamber 40 formed by a cylindrical wall 42 and circular bottom 44. The function of the plenum chamber 40 is to receive air and move it upwardly through the carousel.

Positioned over and around carousel 22 is a cylindrical shroud generally indicated by the numeral 46. The shroud includes cylindrical walls 48 which are supported on frame 10 and a top 50. The shroud top 50 has an opening 52 therein which aligns with the compartments 28 in the carousel as the carousel is rotated. Opening 52 is used to place footballs into and remove them from the compartments in the carousel. Shroud top 50 has a central opening 54 having a bearing 56 therein which rotatably receives the upper end of vertical axle 18.

As shown in FIG. 4, extending across the top of the carousel interior wall 24 is a circular plate 58 having a collar 60. A pin 62 extends through an opening in collar 60 and in the vertical axle 18 to lock the axle to the carousel.

To conserve heat and to prevent the exterior surfaces of shroud 46 from becoming so hot as to possibly alarm anyone touching the shroud, insulation 64 is placed on the interior surfaces of 48 and 50.

As shown best in FIGS. 3 and 4, a wheel 66 is affixed to shaft 18 for the rotation of the carousel. The wheel 66 has spokes 68 which extend to a central hub 70 which in turn receives and is affixed to the upper end of vertical shaft 18. By manually rotating wheel 66, the carousel 22 is rotated to move the compartments in the carousel below opening 52.

As shown in FIG. 3, means is provided to insure alignment of the carousel compartments 28 with opening 52. Wheel 66 has detents 72 therein corresponding in number to the number of compartments 28 in the carousel. A detent follower (best shown in FIG. 4) serves to increase the resistance to rotation of wheel 66 when the carousel compartments are in alignment with opening 52. The detent follower includes a shaft 74 pivoted to the exterior of shroud wall 48. The upper end of shaft 74 has a bearing 76 which rotatably engages the wheel 66 and detents 70. Shaft 74 has an opening (not shown) which receives a bolt 78. A spring 80 between the bolt head and shaft 74 resiliently urges bearing 76 into engagement with the exterior of wheel 66. When the wheel is rotated, bearing 78 enters a detent causing increased rotational torque to turn the wheel so that the user knows when each compartment in the carousel is aligned with opening 52.

As shown in FIGS. 1 and 3, a cylindrical burner housing 82 is mounted and supported on frame 10. The burner housing 82 is shown cut away in FIG. 3 and discloses a burner 84 therein. The actual configuration of the burner 84 may vary in many respects but essentially is a device for burning liquified petroleum gas or other suitable fuel to warm air and generate heat for drying and warming the footballs. Also positioned in the burner housing 82 is a fan 86 driven by electric motor 88. The burner housing output end **82*a* is connected by conduit 90 to the cylindrical plenum chamber 40, the cylindrical wall 42 of which is shown in FIGS. 1 and 3. Air is drawn into the intake end 82*b* of burner housing 82 and is moved by fan 86 past burner 84, through conduit 90, to cylindrical plenum chamber 42 and upwardly into carousel 22 within shroud 46**.

As best shown in FIGS. 2 and 3, a cabinet 92 is positioned on frame 10 adjacent the burner housing 82 and conduit 90. The cabinet 92 is closed on the top, bottom ends and the back side and has a removable front panel (not shown), the front panel being removed in FIG. 2 to disclose the interior arrangement of the cabinet. One compartment **92*a* of the cabinet houses a fuel tank 94. A hose 98 (see FIG. 1) connects the fuel tank 94 with burner 84**.

Compartment **92*b* of the cabinet includes an engine-generator 96 which provides electrical energy for fan motor 88**. An electrical outlet (not shown) may also be provided for convenience in plugging in other electrical equipment, such as a sound system.

A third compartment **92*c* positioned above the engine-generator compartment is used for spare ball storage. The partition 98 between the engine-generator compartment 92*b* and the spare ball storage compartment 92*c* has cutouts 100** therein to partially receive footballs so that they can be supported within the compartment without rolling around.

In extremely cold conditions liquified petroleum gas has low volatility. To make certain that the fuel tank 94 remains at a high enough temperature to supply fuel requirements, a pipe 102 (see FIG. 1) extends from heat conduit 90 and terminates in fuel compartment **92*a* (see FIG. 2). In this way warm air is constantly delivered to the fuel tank compartment 92*a* when the machine is in operation. It can be seen that the heat pipe 102 can collect equally as well with the outlet end 82*a* of the burner housing or with plenum chamber sidewalls 42, the intent being that hot air moving out of the burner housing 82 be conducted into the fuel tank compartment 92*a* sufficient to keep the fuel at a temperature to insure uninterrupted fuel supply to burner 84**.

One or more hand warmers may be added to the machine. For this purpose a small diameter opening (not shown) may be provided in shroud sidewall 84. Connected to the opening as shown in FIGS. 1 and 3, is a short downwardly extending open ended conduit 104. Warm air from within shroud 84 passes out through conduit 104 and serves as a convenient means whereby players may warm their hands. Obviously, a plurality of the conduits 104 spaced around the shroud cylindrical wall 48 may be employed if desired.

OPERATION

With fuel from tank 94 supplied to burner 84, heat is produced. Fam motor 88, which may be energized from the engine-generator 96, or from a separate power cord if the engine-generator 96 is not employed, drives fan 86 which moves air from the output end **82*a* of the burner housing. The hot air flows through conduit 90 into cylindrical plenum chamber 40. From chamber 40, the air moves upwardly through the carousel compartments 28 heating and drying footballs in the compartments. When a wet or cold football is received, it is placed through opening 52 into a compartment 28 in the carousel. The carousel is preferably rotated in one direction. If all compartments of the carousel have footballs, a warm dry ball will be exposed to opening 52 each time the carousel is rotated one position. When a warm, dry ball is removed, it is replaced with a cold, wet ball. In this manner, as the carousel is advanced one position at a time, each ball makes a 360° passage around the interior of the shroud encompassed area wherein it is constantly exposed to the warm air produced in burner housing 82**. By the time a football has moved completely around the carousel, it will have had sufficient time to be completely warm and dry when it is removed.

Burner 84 may be in the form of a radiant heater operated by gas supplied from tank 94, or the radiant heater may be electrically operated using electrical energy from engine-generator 96 or that supplied by an extension cord. The voltage for the radiant heater, if one is used, whether energized by engine-generator 96 or an extension cord, may be 110 volts or 220 volts. In like manner, fan 88 can be energized by engine-generator 96 or by externally supplied electricity using an extension cord.

The dimensions of the football drier unit described herein can be arranged to conform to virtually any size limitations and specifically can be designed to fit the space limitations of aircraft permitting the drier to be transported with other team equipment.

The football drier provided herein is a completely self-contained integral device of minimum size to make constantly available warm, dry footballs. The machine is specifically arranged to be of low profile so as not to obstruct the view of fans and is easily transportable from one place to another and movable onto and off the football field each time it is to be used.

While the invention has been described with a certain degree of particularity, it is manifest that many changes may be made in the details of construction and the arrangement of components without departing from the spirit and scope of this disclosure. It is understood that the invention is not limited to the embodiment set forth herein for purposes of exemplification, but is to be limited only by the scope of the attached claim or claims, including the full range of equivalency to which each element thereof is entitled.

What is claimed is:

1. A football drying apparatus comprising:

a frame having wheels and means to guide the wheels so that the frame may be moved about;

a vertical axle rotatably supported at its lower end to said frame;

a carousel affixed to said vertical axle, the carousel having a plurality of radial partition walls defining a plurality of compartments, each dimensioned to freely receive a football therein;

a cylindrical stationary plenum chamber below said carousel, the bottom of the carousel having openings therein permitting the passage of air from the plenum chamber into the carousel;

a cylindrical shroud surrounding said carousel, the top of the shroud having an opening therein by which a football may be placed into or removed from said carousel compartment, the top of the shroud having a central opening therein rotatably receiving said axle;

means affixed to said axle above said top of said shroud for rotating said axle to thereby rotate said carousel whereby said compartments in said carousel may be selectively brought below said opening in said shroud top to permit footballs to be deposited into or retrieved from said compartments;

a fuel tank supported on said frame;

a burner housing supported on said frame having a burner therein connected to said fuel tank;

an electrically driven fan positioned in said burner housing; and a conduit connecting said burner housing with said plenum chamber whereby hot air from said burner housing is directed by said fan through the conduit to said plenum chamber and up into said shroud surrounding said carousel whereby footballs positioned in said carousel compartments are heated and dried.

2. A football drying apparatus according to claim 1 including an engine generator mounted on said frame, the electrical output of the generator being connected to said fan for energizing said fan.

3. A football drying apparatus according to claim 1 including at least one opening in the cylindrical sidewall of said shroud, and including:

a short downwardly inclined conduit connected to the exterior cylindrical sidewall of said shroud, the conduit being open at each end providing a hot air outlet and functioning as a hand warmer.

4. A football drier according to claim 1 wherein said means affixed to said axle above said top of said shroud for rotating said axle includes a horizontal wheel of approximately the diameter of said shroud, the wheel having spokes connected to said axle.

5. A football drier according to claim 4 wherein said wheel has a detent therein for each said compartment in said carousel and including:

a spring biased detent follower in engagement with said wheel, said follower engaging said detents to exert increased resistance to rotation of said wheel when a said compartment is positioned under said opening in said shroud top.

6. A football drier according to claim 1 including:

a separate compartment mounted on said frame receiving said fuel tank; and a pipe connecting the output of said burner housing with said fuel tank compartment whereby hot air is conducted to said fuel tank compartment to warm said fuel tank.

7. A football drier according to claim 1 including:

a storage compartment supported on said frame for storing extra footballs therein.

* * * * *